US007358195B2

(12) United States Patent
Choi et al.

(10) Patent No.: US 7,358,195 B2
(45) Date of Patent: Apr. 15, 2008

(54) METHOD FOR FABRICATING LIQUID CRYSTAL DISPLAY DEVICE

(75) Inventors: Soon-Ho Choi, Gyungsangbuk-Do (KR); Hyuk-Cheol Son, Gyungsangbuk-Do (KR); Kum-Chul Oh, Gyeonggi-Do (KR); Seung-Hwan Chon, Gyeonggi-Do (KR); Young-Chul Park, Jeollabuk-Do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 113 days.

(21) Appl. No.: 10/950,492

(22) Filed: Sep. 28, 2004

(65) Prior Publication Data

US 2005/0133758 A1 Jun. 23, 2005

(30) Foreign Application Priority Data

Oct. 10, 2003 (KR) ..... 10-2003-0070738

(51) Int. Cl.
*H01L 21/302* (2006.01)
*H01L 21/461* (2006.01)

(52) U.S. Cl. ..... 438/745; 438/688; 438/754; 257/E21.309

(58) Field of Classification Search ..... 438/745, 438/688

See application file for complete search history.

(56) References Cited

U.S. PATENT DOCUMENTS 5,738,931 A * 4/1998 Sato et al. ..... 428/209
6,468,439 B1 * 10/2002 Whitehurst et al. ..... 216/95
2005/0040139 A1 * 2/2005 Gonzalez et al. ..... 216/83

FOREIGN PATENT DOCUMENTS

KR 100163937 B1 9/1998
KR 10-1997-0021864 5/1999
KR 100213470 B1 5/1999
KR 2003-0046851 A 6/2003

* cited by examiner

*Primary Examiner*—Alexander Ghyka
(74) *Attorney, Agent, or Firm*—McKenna Long & Aldridge LLP

(57) ABSTRACT

In etching a metal line formed as a dual layer of aluminum alloy and molybdenum, the metal line consisting of the dual layer of aluminum alloy and molybdenum is etched through one-time wet etching by applying the etchant including $HNO_3$, $HClO_4$, a Ferric compound ($Fe^{3+}$), and a Flouro compound ($F^-$), the process can be reduced and a metal line having a good profile can be formed.

4 Claims, 5 Drawing Sheets

METHOD FOR FABRICATING LIQUID CRYSTAL DISPLAY DEVICE

This application claims the benefit of Korean Patent Application No. 2003-70738, filed on Oct. 10, 2003, which is hereby incorporated by reference for all purposes as if fully set forth herein.

This application hereby incorporates by reference Korean Patent Application No. 10-2003-0020425, filed Apr. 1, 2003, and published Oct. 10, 2003 as Korean Published Patent Application No. 10-2003-0079740.

BACKGROUND OF THE INVENTION

1. Field of the Invention

The present invention relates to an etchant used for fabricating a liquid crystal display device and fabricating method for a liquid crystal display device using the etchant, and more particularly, to an etchant used for forming a gate line and a method for forming a gate line by using the etchant.

2. Discussion of the Related Art

A liquid crystal display panel is one of the most widely used image display devices these days. In particular, a thin film transistor (TFT) liquid crystal display device (TFT LCD), which uses a TFT as a switching device for driving unit pixels, is widely used.

The TFT LCD includes a TFT array substrate on which TFTs as switching devices are arranged in a matrix form, and a color filter substrate having a color filter formed corresponding to the TFT array substrate. Liquid crystal is filled between the TFT array substrate and the color filter substrate.

The TFT array substrate of the liquid crystal display device is where unit pixels are driven by the TFTs, so a process of forming the TFT array substrate is a critical part among processes for forming the TFT liquid crystal display device.

In general, the process of forming the TFT array substrate includes forming a gate electrode; forming a gate insulation layer on the gate electrode; forming a semiconductor layer on the gate insulation layer; forming a source/drain electrode and a data line on the semiconductor layer; forming a passivation layer on the data line; and forming a pixel electrode on the passivation layer.

In particular, the process for forming the gate line and the gate electrode includes depositing a gate metal on a transparent substrate and forming a gate line and a gate electrode through photolithography.

Formation of the gate line will be described in detail with reference to FIGS. 1A through 1D as follows.

First, as illustrated in FIG. 1A, a gate metal 2 such as a copper alloy or aluminum alloy is disposed on a substrate 1 by a sputtering method.

The sputtering method is to deposit metal particles sputtering by a force generated according to collision between a target material and an inactive gas. A metallic thin film is typically deposited through the sputtering method.

As the gate metal, a copper alloy or an aluminum alloy is typically used, and especially, a dual layer of an aluminum alloy and molybdenum is commonly used. The aluminum alloy has excellent electric conductivity and the molybdenum has ohmic contact characteristics with a pad part supplying a gate signal.

After the gate metal layer is formed on the substrate, it is patterned by photolithography to form gate lines and gate electrodes.

That is, as illustrated in FIG. 1B, a photoresist layer 3 is coated at the entire surface of the substrate with the gate metal 2 deposited thereon by a spin coating method, and then, exposed with applying a gate line pattern-formed mask 4.

The photoresist film is a polymer whose bonding structure is changed when exposed to light such as ultraviolet light, and the pattern is formed on the gate metal layer by using such characteristics that the exposed portion is removed or maintained in a developing process.

As illustrated in FIG. 1C, after the photoresist layer 3 is exposed and then developed, a photoresist pattern 5 having the gate line pattern remains on the substrate, and the gate metal layer 2 is etched by applying the photoresist pattern 5 as a mask.

As illustrated in FIG. 1D, the gate metal layer 2 is etched and a gate line 6 is formed through the etching process.

Methods for etching the gate metal 2 includes a wet etching and a dry etching. The wet etching oxidizes the gate metal in a chemical solution to remove it, and the dry etching irradiates ions in a plasma state onto the gate metal to remove the gate metal.

The wet etching has isotropic characteristics that an etching rate is uniform according to an etching direction and the dry etching has anisotropic characteristics that an etching rate is different according to an etching direction.

Many thin layers are formed on the gate line and the gate line needs to be formed in a tapered shape in order to prevent cutting of the thin layer. Thus, to make the gate line have the tapered shape, the wet etching exhibiting the isotropic etching characteristics is used to etch the gate line.

In the related art in which the dual layer of the aluminum alloy and molybdenum is used as the gate metal and a mixed solution of $H_3PO_4$, $HNO_3$ and $CH_3COOH$ is used as an etchant, each etching rates of the aluminum alloy layer and of the molybdenum layer are different in the etchant, so the tapered shape is deformed.

FIGS. 2A and 2B illustrate a method in which a dual layer of aluminum alloy layer and a molybdenum layer is used as the gate metal layer, and the gate line is formed using a mixed solution of phosphoric acid ($H_3PO_4$), nitric acid ($HNO_3$) and acetic acid ($CH_3COOH$) as an etchant.

FIG. 2A illustrates the aluminum alloy layer 21 and the molybdenum layer 22 having different etching rates. In this case, the aluminum alloy layer 21 is etched by phosphoric acid of the etchant and the molybdenum layer 22 is etched by nitric acid of the etchant. Because the reactivity between the aluminum alloy layer 21 and phosphoric acid is greater than that between the molybdenum layer 22 and nitric acid, the molybdenum layer 22 at the upper side of the aluminum alloy layer 21 is larger than the etched aluminum alloy layer 21 after etching process, as illustrated in FIG. 2A.

Thus, in order to make a perfectly tapered form, the wet etched-molybdenum layer 22 needs to be etched one more time by dry etching. Then, the molybdenum layer 22 has such a tapered form as the aluminum alloy layer 21.

FIG. 2B illustrates the stacked molybdenum layer 22 and aluminum alloy layer 21 tapered by the dry etching.

After the etching process is finished, the photoresist remaining on the substrate is removed and washed to form gate lines.

To sum up, the gate line forming process may include a step of depositing the gate metal on the substrate; a step of forming the photoresist layer pattern on the gate metal; a step of performing a wet-etching by applying the photoresist layer pattern as a mask; a step of additionally dry-etching the wet etched-gate metal; and a step of removing the photoresist layer and performing a washing.

In the process of fabricating the TFT array using the dual layer of aluminum alloy layer and the molybdenum layer, if the related art etchant is used, the wet etching is performed and then the dry etching is to be performed additionally, causing a process delay. In addition, since an equipment for the dry etching is required, an expense is increased.

Moreover, as for the pattern of the gate line by using the conventional etchant, since the side tilt angle of the tapered form is so large that cutting is caused in forming a thin layer on the gate line.

FIG. 3 is a photograph taken by electron microscope showing a gate line etched by using the related art etchant. As shown, a profile of the gate line has a sharp tilt.

The profile of the gate line is sensitive to the cutting of various thin films formed on the gate line, so it is critical for the gate line to have a gentle, rather than a sharp, profile in order to prevent cutting.

SUMMARY OF THE INVENTION

Accordingly, the present invention is directed to a method for fabricating a liquid crystal display device that substantially obviates one or more of the problems due to limitations and disadvantages of the related art.

Therefore, one advantage of the present invention is to provide an etchant capable of forming a gate line by one-time wet etching in a step of forming a gate line using a dual layer of an aluminum alloy layer and a molybdenum layer among steps for forming a liquid crystal display device.

Another advantage of the present invention is to form a gate line by applying the etchant to thereby improve a profile of the gate line and prevent defective cutting that may be generated during a process for forming a thin film on the gate line.

Still another advantage of the present invention is to reduce a process by forming the gate line through one-time wet etching in the gate line forming process.

To achieve these and other advantages and in accordance with the purpose of the present invention, as embodied and broadly described herein, there is provided an etchant comprising $HNO_3$, a Ferric compound, $HClO_4$ and a Flouro compound. In one aspect of the present invention, the Ferric compound may be $Fe(NO_3)_3$. In another aspect of the present invention, the Flouro compound may be $NH_4F$. In addition, the Ferric compound may be one of $FeCl_3$, $Fe_2(SO_4)_3$ and $NH_4Fe(SO_4)_2$ and the Flouro compound may be one of $NH_4HF_2$, HF, NaF, and KF.

To achieve the above advantages, there is also provided to a method for forming a gate line by applying the etchant including: forming a gate metal on a substrate; and etching the gate metal by applying an etchant including $HNO_3$, a Ferric compound, $HClO_4$ and a Flouro compound. In one aspect of the present invention, the Ferric compound may be $Fe(NO_3)_3$. In another aspect of the present invention, the Flouro compound may be $NH_4F$. In addition, the Ferric compound may be one of $FeCl_3$, $Fe_2(SO_4)_3$, and $NH_4Fe(SO_4)_2$ and the Flouro compound may be one of $NH_4HF_2$, HF, NaF, and KF.

To achieve the above advantages, there is also provided a method for fabricating a TFT array substrate by applying the etchant including a gate line forming step including forming an aluminum alloy on a substrate, forming a molybdenum alloy on the aluminum alloy, and etching the dual layer of the aluminum alloy and the molybdenum alloy by an etching including $HNO_3$, a Ferric compound, $HClO_4$ and a Flouro compound, forming a gate insulation film on the gate line, forming a semiconductor layer on the gate insulation film, forming source/drain electrodes on the semiconductor layer, and forming a passivation film on the source/drain electrodes; and forming a pixel electrode. In one aspect of the present invention, the Ferric compound may be $Fe(NO_3)_3$. In another aspect of the present invention, the Flouro compound may be $NH_4F$. In addition, the Ferric compound may be one of $FeCl_3$, $Fe_2(SO_4)_3$, and $NH_4Fe(SO_4)_2$ and the Flouro compound may be one of $NH_4HF_2$ , HF, NaF, and KF.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Figure 1A:
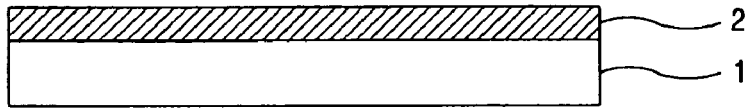
FIG. 1A RELATED ART
FIGS. 1A through 1D show sequential processes for forming a gate line of a liquid crystal display device in accordance with a related art.
Figure 1B:
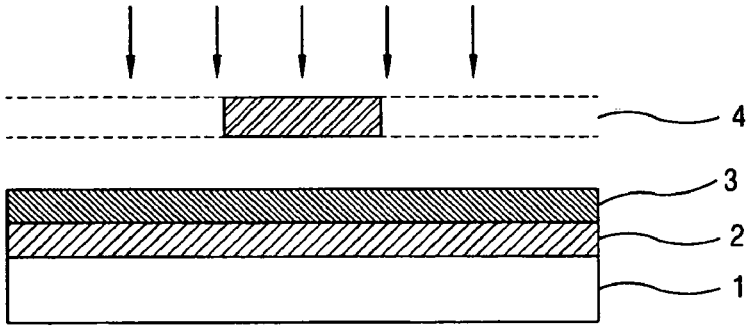
FIG. 1B RELATED ART
Figure 1C:
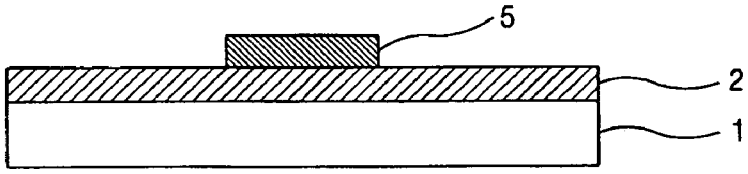
FIG. 1C RELATED ART
Figure 1D:
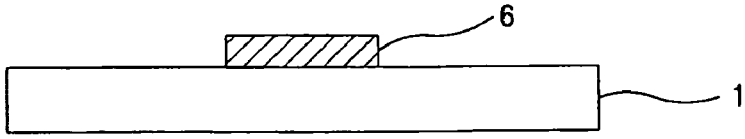
FIG. 1D RELATED ART
Figure 2A:
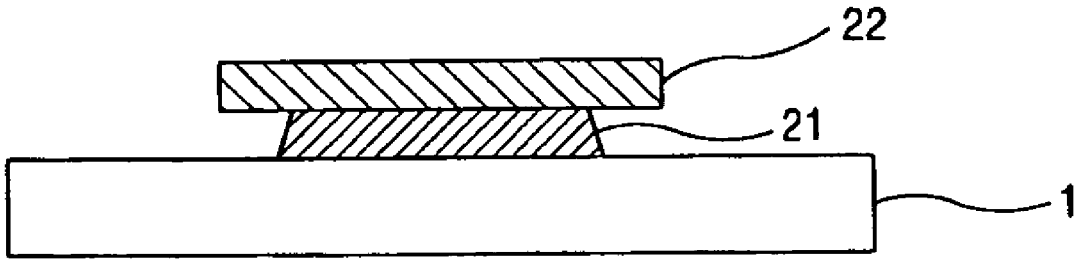
FIG. 2A RELATED ART
FIGS. 2A and 2B are sectional view showing an etched form of the gate line in accordance with the related art.
Figure 2B:
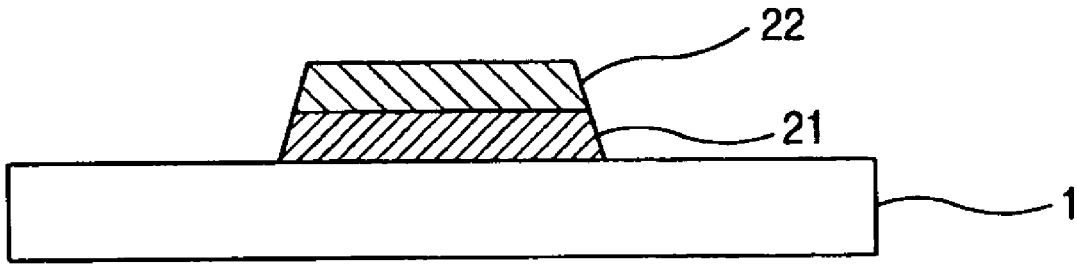
FIG. 2B RELATED ART
Figure 3:
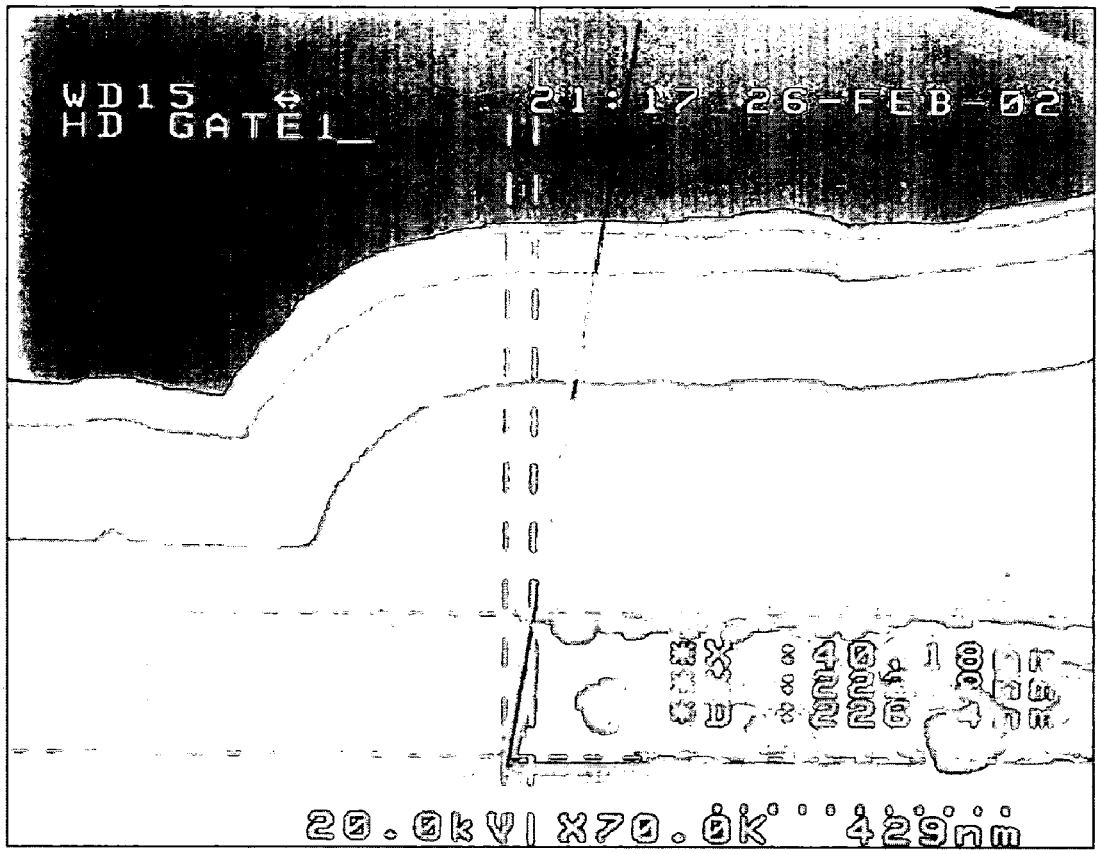
FIG. 3 RELATED ART
FIG. 3 is a photograph taken by an electron microscope showing a profile of the gate line formed by using a gate metal etching etchant in accordance with the related art.

Reference will now be made in detail to an embodiment of the present invention, example of which is illustrated in the accompanying drawings.

The present invention provides a new etchant for etching a metal. The present invention will now be described in detail.

An etchant of the present invention used for etching a gate metal includes $HNO_3$, $HClO_4$, a Ferric compound ($Fe^{3+}$), and a Flouro compound ($F^-$). The Ferric compound may be one of $Fe(NO_3)_3$, $FeCl_3$, $Fe_2(SO_4)_3$, and $NH_4Fe(SO_4)_2$. The Flouro compound may be one $NH_4F$, $NH_4NF_2$, HF, NaF and KF. In general, the Ferric compound may be any compound that provides $Fe^{3+}$ ions, and the Flouro compound may be any compound that provides $F^-$ ions. The $HClO_4$ may be replaced with one of $H_2SO_4$, HClO, $HClO_2$ and $HClO_3$.

In one embodiment of the present invention, for example, the weight ratio of $HNO_3$, the Ferric compound, $HClO_4$ and the Flouro compound may be about 7~12 wt %, 2~4 wt %, 1~4 wt % and 0.1~2.0 wt %, respectively. In this exemplary case, the Ferric compound may be $Fe(NO_3)_3$ and the Flouro compound may be $NH_4F$. More particularly, the etchant weight percent of $HNO_3$, the Ferric compound, $HClO_4$ and the Flouro compound may be about 10 wt %, about 3 wt %, about 3 wt % and about 0.4 wt %, respectively.

The process by which the components of the etchant reacts with a dual layer of an aluminum alloy layer and a molybdenum layer constituting a gate line to etch the dual will now be described with reaction formulas.

[Reaction Formula 1]

The molybdenum layer of the gate metal reacts with nitric acid of the etchant component of the present invention according to the following equations:

$$2Mo \rightarrow 2Mo^{3+} + 6e^-$$

$$6H^+ + 6e^- \rightarrow 3H_2 \text{ (derived from nitric acid } (HNO_3))$$

$$2Mo + 6H^+ \rightarrow 2Mo^{3+} + 3H_2$$

As in the above reaction formula, the molybdenum layer is removed by oxidation and reduction with nitric acid. Namely, while hydrogen ions derived from nitric acid are reduced, molybdenum is oxidized and removed.

[Reaction Formula 2]

The aluminum alloy layer of the gate metal is removed by reacting with $Fe(NO_3)_3$ of the etchant according to the following equations.

$$Al \rightarrow Al^{3+} + 3e-$$

$$3Fe^{3+} + 3e- \rightarrow 3Fe^{2+} \text{ (derived from a Ferric compound, e.g., } Fe(NO_3)_3)$$

$$Al + 3Fe^{3+} \rightarrow Al^{3+} + 3Fe^{2+}$$

Through the above reaction formula, the aluminum layer is removed by oxidation and reduction with $Fe(NO_3)_3$ of the etchant. Namely, while $Fe^{3+}$ derived from the nitric acid is reduced, aluminum alloy is oxidized and removed. Thus, as one of skill in the art would appreciate, any compound providing $Fe^{3+}$ ions can be used.

$HClO_4$ of the etchant creates an environment in which an etching reaction can be actively made by lowering pH of the etchant. A Flouro compound that provides Flouride ions ($F^-$), such as $NH_4F$, $NH_4HF_2$, HF, NaF, and KF, helps to prevent residual etched particles from being adsorbed onto the surface of the gate metal while etching is performed and re-absorption of oxidized molybdenum ion.

In particular, perchloric acid $HClO_4$ is stronger than hydrochloric acid, and the more oxygen is included in hydrochloric acid, the stronger acidity the hydrochloric acid has. $H_2SO_4$ or HClO, $HClO_2$ or $HClO_3$ may be also used in place of $HClO_4$.

The gate line constituted as the dual layer of the aluminum alloy layer and the molybdenum layer is removed by reacting with $HNO_3$ and $Fe(NO_3)_3$ among the etchant component.

At this time, since the aluminum alloy layer and the molybdenum layer have the similar etching rates, the gate line may be etched in a perfect tapered shape by wet etching.

In addition, when that the gate line is formed by applying the etchant of the present invention, a profile of the gate line is improved and the profile of the tapered gate line has a gentle side tilt angle. The profile of the gate line is very important in order to prevent cutting in a depositing process of a thin layer formed on the gate line, and in this respect, with the gentler slope of the profile, defective cutting may be prevented.

Figure 4:
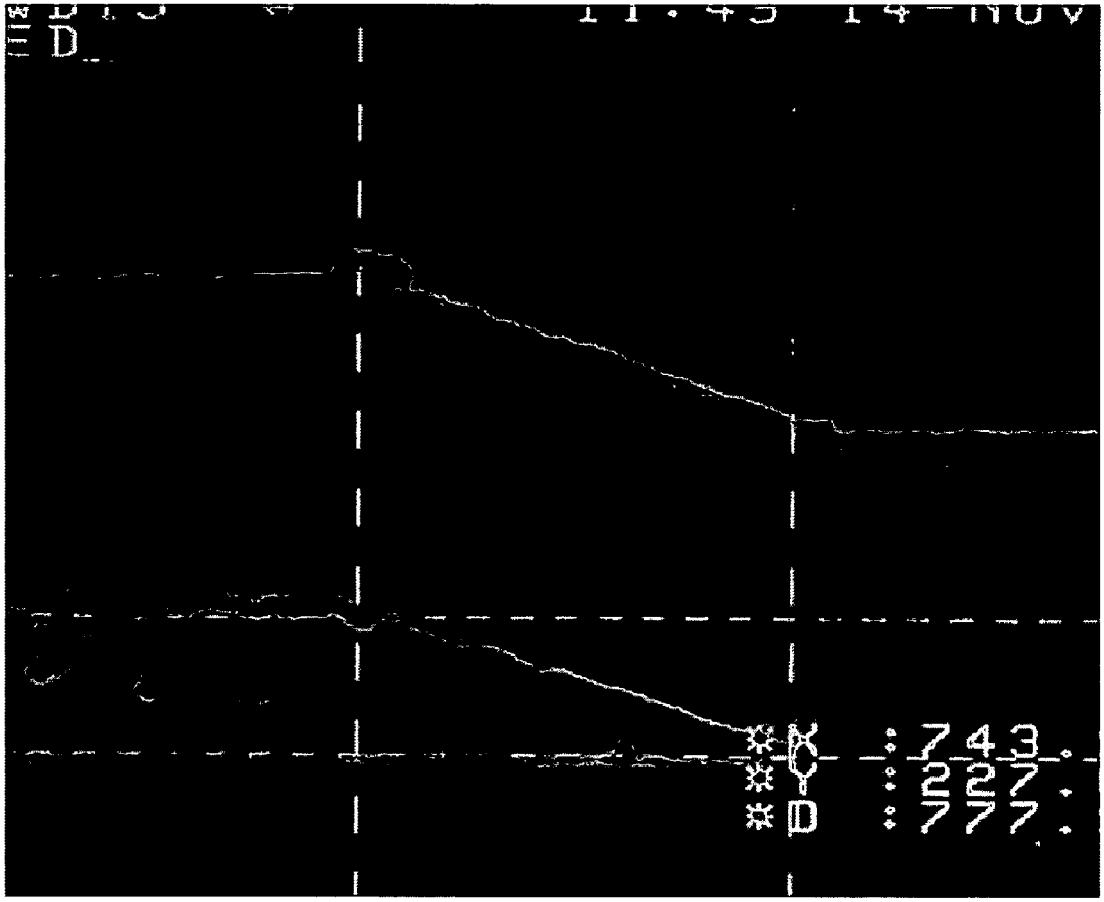
FIG. 4 is a photograph taken by an electron microscope showing a profile of a gate line formed by applying an etchant in accordance with a present invention.

FIG. 4 is a photograph taken by an electron microscope showing a gate line having an improved profile by using an etchant in accordance with the present invention.

As shown in FIG. 4, the tilt angle of the side profile of the tapered gate line is about 45 degrees, showing an improvement compared to the gate line of the related art which has a profile tilt angle of about 70~80 degrees.

The process for forming a gate line made up of a dual layer of an aluminum alloy and molybdenum by applying an etchant in accordance with the present invention will be described. The gate line forming process includes preparing a substrate; forming an aluminum alloy layer on the substrate; forming a molybdenum layer on the aluminum alloy layer; performing an etching by applying the etchant to the dual layer of the aluminum and molybdenum; and washing the gate line-formed substrate.

The process of forming the gate line by using the etchant will now be described in detail with reference to FIGS. 5A to 5D.

Figure 5A:
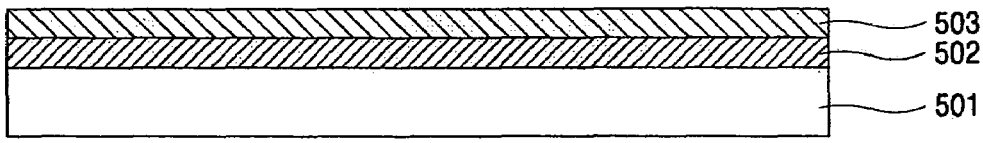
FIGS. 5A to 5D show sequential processes for forming a metal line by applying the etchant in accordance with the present invention.

With reference to FIG. 5A, an aluminum alloy layer 502 and a molybdenum layer 503 are successively deposited at the entire surface of a transparent substrate 501 through a sputtering method. Since the aluminum alloy has excellent electric conductivity and is inexpensive, it is suitable for formation of the gate line. However, since the aluminum alloy does not have good ohmic contact characteristics with respect to a pixel electrode material at a pad part applying a gate signal, the molybdenum layer 530 is formed on the aluminum alloy layer 502. Molybdenum has good ohmic contact characteristics with the pixel electrode material.

Figure 5B:
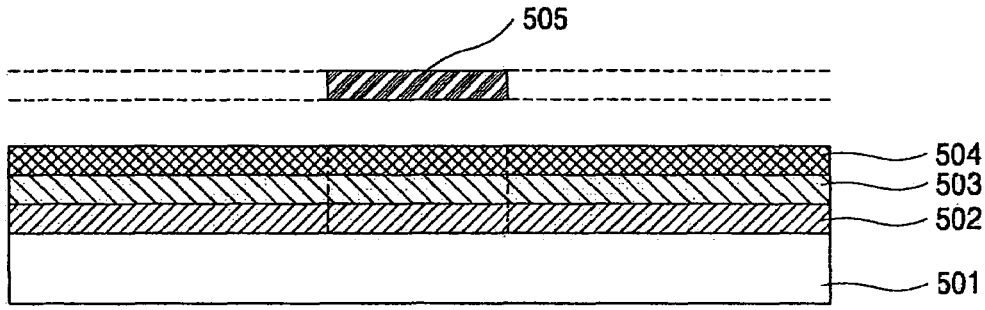

Next, as illustrated in FIG. 5B, a photoresist 504 is formed on the molybdenum layer 503. The photoresist 504 may be divided into a positive type photoresist of which a light irradiated-region is removed and a negative type photoresist of which the light irradiated-region remains. The negative type or positive type photoresist may be suitably selected for use according to circumstances, and the exemplary embodiment of present invention describes the positive type photoresist. One of the skills in the art should appreciate that a negative type photoresist could also be used.

After the photoresist 504 is coated, as illustrated in FIG. 5B, an exposing process is performed by applying a mask 505 including a gate line and gate electrode pattern. Through the exposing process, a light irradiated-region is changed in its chemical structure to a form that can be removed in a develop process.

After the exposing process is performed, the substrate is passed through a container storing a developer, thereby performing the develop process. After the develop process, the photoresist remains on the molybdenum layer 503 in a certain pattern.

Figure 5C:
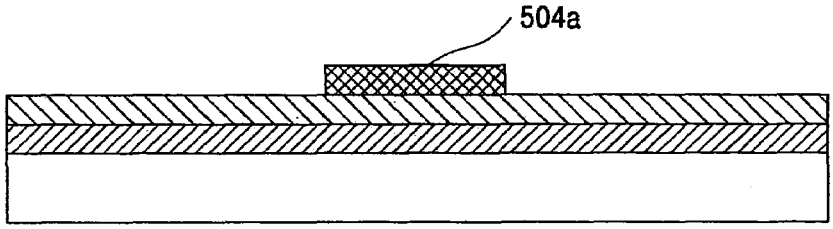
Figure 5D:
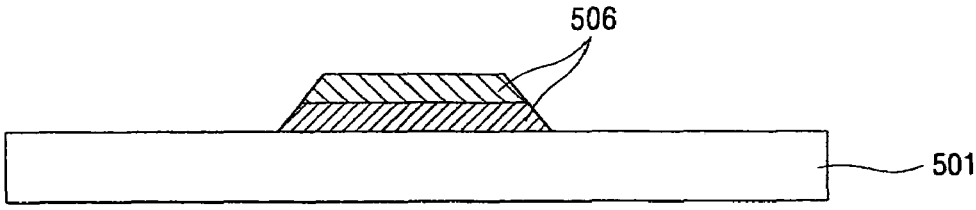

Subsequently, as illustrated in FIG. 5C, a gate line pattern is formed by performing one-time wet etching on the dual layer of molybdenum and aluminum alloy by applying the patterned photoresist 504*a* as a mask. Generally, etching may take place for about 50-70 sec.

Referring back to the related art, the related art etching process needs to be performed twice, namely, the wet etching and the dry etching, in order to etch the aluminum alloy and the molybdenum layer. By comparison, in the present invention, the dual layer of molybdenum and aluminum alloy may be effectively patterned by one-time wet etching using the etchant.

Then, a washing process for removing a particles remaining at the patterned gate line is performed to thereby complete the gate line 506.

Though not illustrated in FIG. 5, after the gate line is formed, a gate insulation film forming process, a process for forming a semiconductor layer consisting of an amorphous silicon layer and ohmic contact layer, a process of forming source/drain electrodes and a data line on the semiconductor layer, a process of forming a passivation film, and a process of forming a pixel electrode may be additionally performed to form a TFT array substrate. In particular, if the source/drain electrodes and the data line are made of the same material, the etchant may be applied in the process of forming the source/drain electrodes.

As so far described, the prevent invention has the following advantages. That is, for example, because the metal line consisting of the dual layer of aluminum alloy and molybdenum may be effectively removed through one-time wet etching by applying the etchant including $HNO_3$, $HClO_4$, a Ferric compound and a Flouro compound the process can be reduced and productivity can be increased.

In addition, in forming the gate line formed as the dual layer of the aluminum alloy and molybdenum, the gate line can be formed in a tapered shape with a gentle tilt angle, so that when a film is formed on the gate line, generation of cutting is prevented.

Moreover, since the dry etching that etches by making plasma ions collided to the thin film, is not performed, the etching can be effectively made without a mark on the substrate.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method for forming a metal line, comprising:

forming a metal layer on a substrate, wherein the metal layer comprises an aluminum alloy layer and a molybdenum layer on the aluminum alloy layer; and etching by one wet etching process the metal layer by applying an etchant including $HNO_3$, $HClO_4$, a Ferric compound ($Fe^{3+}$), and a Flouro compound ($F^-$).

2. The method of claim 1, further comprising:

forming a photoresist on the metal layer;

exposing the photoresist layer; and developing the photoresist layer.

3. The method of claim 1, wherein the Flouro compound is one of $NH_4F$, $NH_4HF_2$, HF, NaF, and KF.

4. The method of claim 1, wherein the Ferric compound is one of $Fe(NO_3)_3$, $FeCl_3$, $Fe_2(SO_4)_3$ and $NH_4Fe(SO_4)_2$.

* * * * *